US009229378B1

(12) United States Patent
Matsubara et al.

(10) Patent No.: US 9,229,378 B1
(45) Date of Patent: Jan. 5, 2016

(54) FIXING DEVICE AND IMAGE FORMING APPARATUS

(71) Applicant: FUJI XEROX CO., LTD., Tokyo (JP)

(72) Inventors: Takashi Matsubara, Kanagawa (JP); Tetsuro Kodera, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/706,496

(22) Filed: May 7, 2015

(30) Foreign Application Priority Data

Dec. 4, 2014 (JP) ..... 2014-246243

(51) Int. Cl.
*G03G 15/20* (2006.01)

(52) U.S. Cl.
CPC ..... *G03G 15/2007* (2013.01)

(58) Field of Classification Search
CPC ..... G03G 15/2007; G03G 15/201
USPC ..... 399/336
See application file for complete search history.

(56) References Cited

U.S. PATENT DOCUMENTS

2011/0262196 A1* 10/2011 Maeda ..... G03G 15/2007 399/336
2012/0045238 A1* 2/2012 Maeda ..... G03G 15/201 399/67
2014/0241765 A1 8/2014 Kodera

FOREIGN PATENT DOCUMENTS

JP 2011-128223 A 6/2011
JP 2014-164022 A 9/2014

* cited by examiner

*Primary Examiner* — David Bolduc
*Assistant Examiner* — Barnabas Fekete
(74) *Attorney, Agent, or Firm* — Oliff PLC

(57) ABSTRACT

Provided is a fixing device including an endless belt that rotates around an axis, transmits light, and has an inner peripheral surface to which a lubricating liquid adheres, a lens that has a curved surface having a top portion closest to the inner peripheral surface at one end when viewed in the axial direction, and concentrates light incident on the curved surface on a developer image on a medium that comes in contact with an outer peripheral surface of the belt that comes in contact with the other end, and a light source that allows the light to be concentrated on the developer image to be incident on a portion on an upstream side of the belt of an outer peripheral surface of a portion of the belt facing the top portion in the rotation direction.

10 Claims, 9 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2014-246243 filed Dec. 4, 2014.

BACKGROUND

Technical Field

The present invention relates to a fixing device and an image forming apparatus.

SUMMARY

According to an aspect of the invention, there is provided a fixing device including:

an endless belt that rotates around an axis, transmits light, and has an inner peripheral surface to which a lubricating liquid adheres;

a lens that has a curved surface having a top portion closest to the inner peripheral surface at one end when viewed in the axial direction, and concentrates light incident on the curved surface on a developer image on a medium that comes in contact with an outer peripheral surface of the belt that comes in contact with the other end; and a light source that allows the light to be concentrated on the developer image to be incident on a portion on an upstream side of the belt of an outer peripheral surface of a portion of the belt facing the top portion in the rotation direction.

BRIEF DESCRIPTION OF THE DRAWINGS

Exemplary embodiments of the present invention will be described in detail based on the following figures, wherein.

DETAILED DESCRIPTION

Outline

Figure 1:
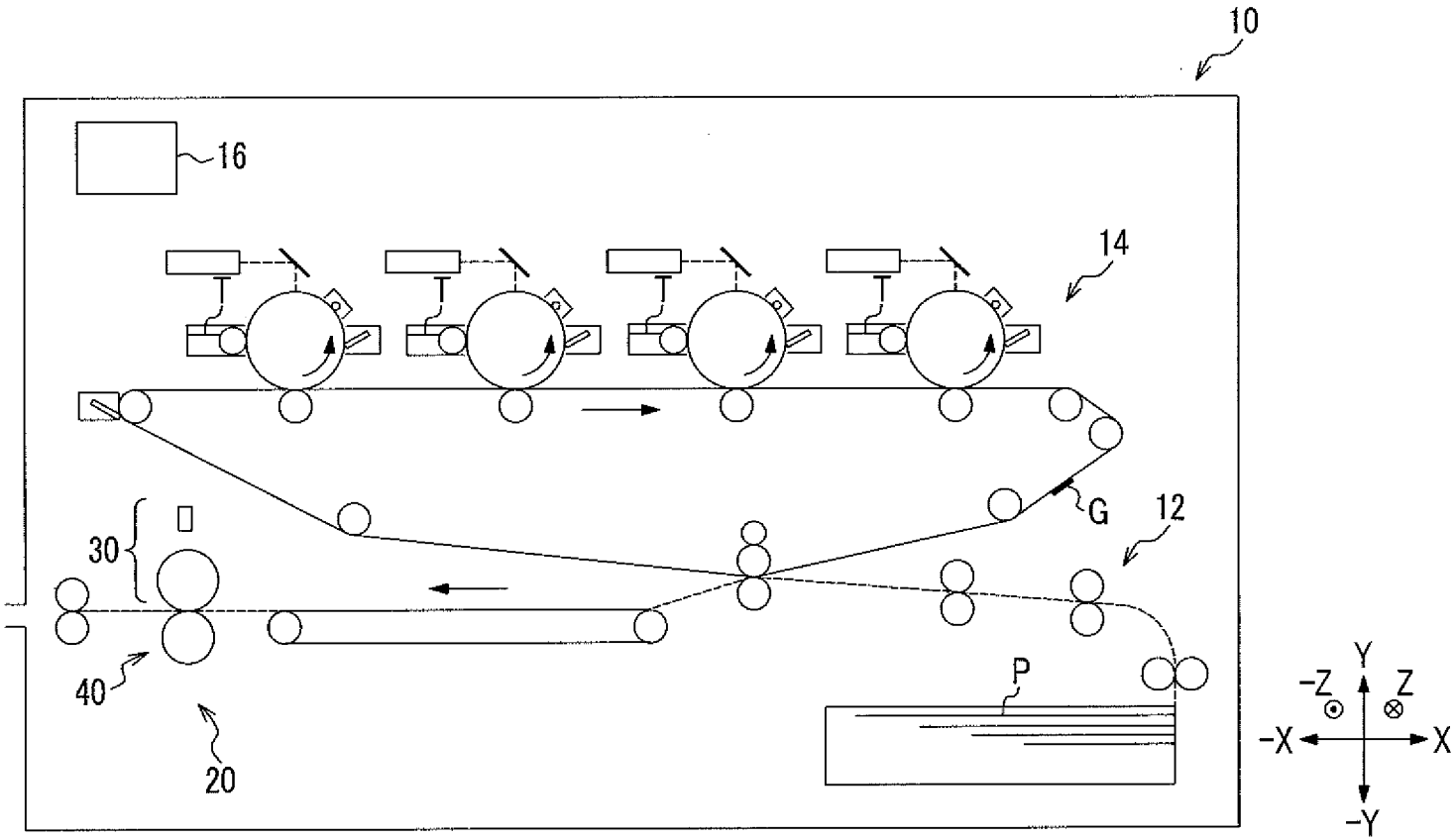
FIG. 1 is a schematic diagram (front view) showing an image forming apparatus according to a first exemplary embodiment.

Hereinafter, three exemplary embodiments (first to third exemplary embodiments) which are exemplary embodiments for implementing the present invention (hereinafter, referred to as exemplary embodiments) will be described with reference to the drawings.

In the following description, it is assumed that a direction represented by an arrow X and an arrow −X in the drawings is an apparatus width direction, and a direction represented by an arrow Y and an arrow −Y in the drawings is an apparatus height direction. It is assumed that a direction (a direction represented by an arrow Z and an arrow −Z) perpendicular to the apparatus width direction and the apparatus height direction is an apparatus depth direction. When it is necessary to distinguish one side of the apparatus width direction, the apparatus height direction or the apparatus depth direction from the other side thereof, it is assumed that a side of the arrow X is one side, a side of the arrow −X is the other side, a side of the arrow Y is an upper side, a side of the arrow −Y is a lower side, a side of the arrow Z is a back side, and a side of the arrow −Z is a front side. Here, the apparatus depth direction is an example of an axial direction.

First Exemplary Embodiment

[Outline]

Hereinafter, the present exemplary embodiment will be described. The entire configuration of an image forming apparatus 10 according to the present exemplary embodiment will be first described. Subsequently, the configuration of a fixing device 20 according to the present exemplary embodiment will be described. Subsequently, the operation of the image forming apparatus 10 according to the present exemplary embodiment will be described. Subsequently, the effects according to the present exemplary embodiment will be described.

[Entire Configuration of Image Forming Apparatus]

As shown in FIG. 1, the image forming apparatus 10 is implemented as an electrophotographic image forming apparatus that includes a transport unit 12, a toner image forming unit 14, a control unit 16, and the fixing device 20. The transport unit 12 has a function of transporting a medium P. The toner image forming unit 14 has a function of forming a toner image G formed with a toner T on the transported medium P by performing processes such as charging, exposing, developing, and transferring. The control unit 16 has a function of controlling the units other than the control unit 16 constituting the image forming apparatus 10. The fixing device 20 has a function of fixing the toner image G on the medium P. Here, the toner T is an example of a developer. The toner image G is an example of a developer image. The toner image forming unit 14 is an example of a forming unit.

[Fixing Device]

Figure 2:
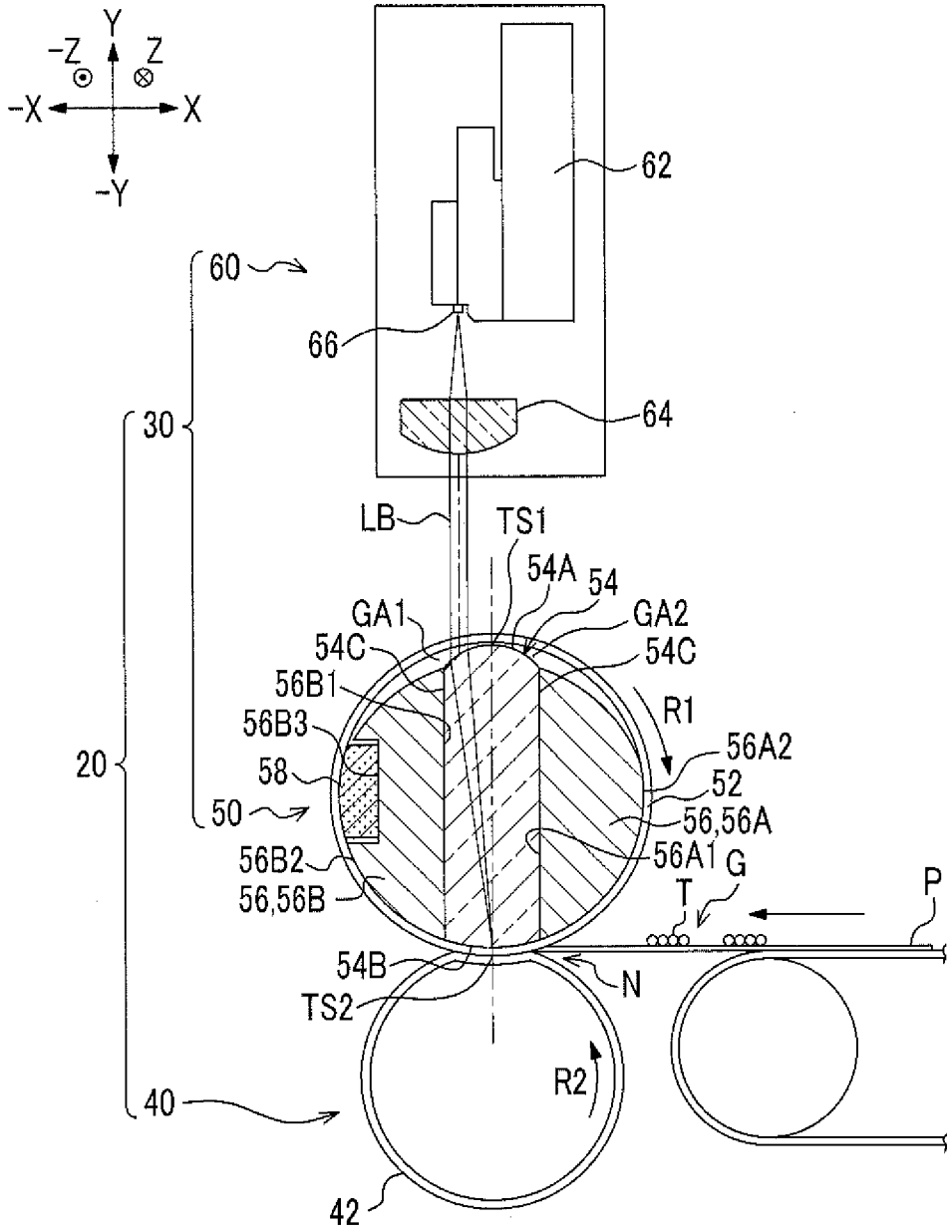
FIG. 2 is a schematic diagram (front view) showing a fixing device constituting the image forming apparatus according to the first exemplary embodiment.

As shown in FIG. 2, the fixing device 20 includes a heating unit 30, and a pressure unit 40.

[Heating Unit]

The heating unit 30 has a function of heating the toner image G formed on the medium P by the toner image forming unit 14. The heating unit 30 includes a main member 50, and light irradiation units 60.

<Main Member>

The main member 50 includes a transparent belt 52, a cap (not shown), a gear (not shown), a lens 54, a guide unit 56, and a lubricating-liquid supply unit 58 (hereinafter, referred to as a supply unit 58). Here, the transparent belt 52 is an example of an endless belt.

(Transparent Belt)

The transparent belt 52 has an endless shape, and is disposed with an axis thereof parallel to the apparatus depth direction. The cap (not shown) is fitted into an end of the transparent belt 52 on the front side in the apparatus depth direction, and the gear (not shown) is fitted into an end thereof on the backside in the apparatus depth direction. The gear (not shown) rotates around an axis (its own axis) by a driving source (not shown), and thus, the transparent belt 52 rotates around the axis (in a direction of an arrow R1 in the drawing).

The transparent belt 52 is configured such that a part of light LB (laser beam) output from the light irradiation unit 60 to be described below is transmitted. In the present exemplary embodiment, the transmittance of the light LB output from the light irradiation unit 60 in the transparent belt 52 (the percentage of the light LB which passes through the transparent belt 52 and is output from an inner peripheral surface with respect to the light LB incident on an outer peripheral surface of the transparent belt 52) is, for example, 95%.

Figure 3:
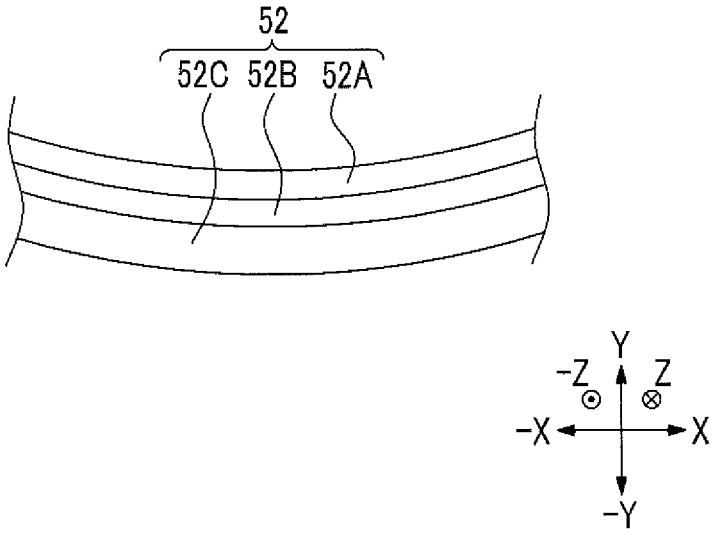
FIG. 3 is a partial cross-sectional view showing a layer structure of a belt constituting the fixing device according to the first exemplary embodiment.

As shown in FIG. 3, the transparent belt 52 according to the present exemplary embodiment includes three layers including a base layer 52A, an elastic layer 52B laminated on the base layer 52A, and a release layer 52C laminated on the elastic layer 52B which are formed from the inner peripheral side to the outer peripheral side. The base layer 52A allows the transparent belt 52 to maintain necessary strength, the elastic layer 52B allows the transparent belt 52 to have properties of an elastic member, and the release layer 52C has a function of allowing the toner T heated on the medium P not to be offset on the transparent belt 52.

(Lens)

As shown in FIG. 2, the lens 54 has a function of concentrating the light LB incident on the end on the developer image G on the medium P that comes in contact with the outer peripheral surface of the transparent belt 52 that comes in contact with the other end when viewed in the apparatus depth direction.

The lens 54 is disposed inside the transparent belt 52. The lens 54 is long when viewed in the apparatus depth direction, and is disposed with a longitudinal direction thereof parallel to the apparatus height direction. The lens 54 is long when viewed in the apparatus width direction, and is disposed with a longitudinal direction thereof parallel to the apparatus depth direction (not shown).

A curved surface 54A which has a top portion TS1 closest to the inner peripheral surface of the transparent belt 52 and protrudes toward the upper side in the apparatus height direction is formed at an end (one end) of the lens 54 on the upper side in the apparatus height direction. A curved surface 54B that protrudes toward the lower side in the apparatus height direction is formed at an end (the other end) of the lens 54 on the lower side in the apparatus height direction. The transparent belt 52 is wound around the curved surface 54B of the lens 54 using silicone oil O to be described below. A curvature of the curved surface 54A is greater than a curvature of the curved surface 54B. Planar surfaces 54C parallel with the apparatus height direction are formed at both ends of the lens 54 in a transverse direction when viewed in the apparatus depth direction.

When viewed in the apparatus depth direction, the lens 54 is symmetric with respect to a straight imaginary line (a dashed line in the drawing) which passes through the top portion TS1 and is parallel to the apparatus height direction.

In such a configuration, when viewed in the apparatus depth direction, the lens 54 is configured to concentrate the light LB incident on the curved surface 54A on a central portion TS2 (indicating an overlapped portion with the dashed line in the drawing) of the curved surface 54B by using the apparatus height direction as a traveling direction.

(Guide Unit)

As shown in FIG. 2, the guide unit 56 has a function of supporting the lens 54 while sandwiching the lens from both sides in the apparatus width direction, and a function of guiding the transparent belt 52 that rotates around the axis such that the transparent belt rotates while maintaining a cylindrical shape. The guide unit 56 includes a first guide section 56A, and a second guide section 56B. Both the first guide section 56A and the second guide section 56B are long, and are arranged inside the transparent belt 52 with longitudinal directions thereof parallel to the apparatus depth direction.

When viewed in the apparatus depth direction, a planar surface 56A1 parallel with the apparatus height direction is formed on one side (a side of the −X direction) of the first guide section 56A in the apparatus width direction. When viewed in the apparatus depth direction, a gently curved surface 56A2 that protrudes toward the other side in the apparatus depth direction is formed on the other side of the first guide section 56A in the apparatus width direction (a side of the X direction).

When viewed in the apparatus depth direction, a gently curved surface 56B2 that protrudes toward the one side in the apparatus depth direction is formed on one side of the second guide section 56B in the apparatus width direction. When viewed in the apparatus depth direction, a planar surface 56B1 parallel with the apparatus height direction is formed on the other side of the second guide section 563 in the apparatus width direction. A concave portion 56B3 that is opened in one side in the apparatus width direction is formed over the entire region of the gently curved surface 5632 in the apparatus depth direction. The supply unit 58 to be described below is accommodated in the concave portion 56B3.

The widths of the planar surface 56A1 and the planar surface 56B1 in the transverse direction are equal to the widths of the planar surfaces 54C of the lens 54 in the transverse direction. The guide unit 56 supports the lens 54 while the entire region of the planar surface 56A1 of the first guide section 56A is overlapped with the entire region of the planar surface 54C on the other side of the lens 54 in the apparatus width direction and the entire region of the planar surface 5631 of the second guide section 56B is overlapped with the entire region of the planar surface 54C on one side of the lens 54 in the apparatus width direction.

The curvatures of the gently curved surface 56A2 of the first guide section 56A and the gently curved surface 56B2 of the second guide section 56B are smaller than the curvature of the curved surface 54A of the lens 54. For this reason, when viewed in the apparatus depth direction, a boundary between the gently curved surface 56A2 and the curved surface 54A and a boundary between the gently curved surface 5632 and the curved surface 54A are connected as a discontinuous curved surface. In contrast, the curvatures of the gently curved surface 56A2 of the first guide section 56A and the gently curved surface 56B2 of the second guide section 563 are equal to the curvature of the curved surface 54B of the lens 54. Thus, when viewed in the apparatus depth direction, a boundary between the gently curved surface 56A2 and the curved surface 54B and a boundary between the gently curved surface 56B2 and the curved surface 54B are connected as a continuous curved surface.

(Supply Unit)

The supply unit 58 has a function of supplying silicone oil O (see FIGS. 5 and 6) to the inner peripheral surface of the transparent belt 52. Here, the silicone oil O is an example of a lubricating liquid. The silicone oil O is used to improve the slippage of the transparent belt 52 (to reduce friction) with respect to the curved surface 543 of the lens 54 by being provided between the curved surface 54B of the lens 54 and the inner peripheral surface of the transparent belt 52 that rotates around the axis. The silicone oil O may transmit the light LB.

The supply unit 58 is long. As shown in FIG. 2, the supply unit 58 is accommodated within the concave portion 5633 formed in the second guide section 566 while the longitudinal direction thereof is parallel to the apparatus depth direction and a part thereof protrudes. The part of the supply unit 58 protruding from the concave portion 56B3 comes in contact with the inner peripheral surface of the transparent belt 52. The supply unit 58 according to the present exemplary embodiment is made of, for example, a felt material, and the felt material is impregnated with the silicone oil O. Thus, the supply unit 58 is configured to supply the impregnated silicone oil O to a portion of the inner peripheral surface of the transparent belt 52 coming in contact with the supply unit 58. As a result, the transparent belt 52 rotates around the axis, and thus, the silicone oil O impregnated in the supply unit 58 is supplied to the entire inner peripheral surface of the transparent belt 52.

<Light Irradiation Unit>

The light irradiation unit 60 has a function of applying the light LB for heating the toner image G formed on the medium P. As shown in FIG. 2, the light irradiation unit 60 includes a laser array 62, and a collimating lens 64. In the heating unit 30 according to the present exemplary embodiment, the plural light irradiation units 60 are arranged in the apparatus depth direction. The respective light irradiation units 60 are arranged on the upper side of the transparent belt 52. Each laser array 62 includes plural light sources 66 arranged in the apparatus depth direction (not shown).

The light source 66 allows the light LB traveling in the apparatus height direction to be incident on a portion, which is positioned on the upstream side of the transparent belt 52 in the rotation direction than an outer peripheral surface of a portion of the transparent belt 52 facing the top portion TS1 of the lens 54, and is overlapped with the curved surface 54A of the lens 54. Specifically, when viewed in the apparatus depth direction, the light source 66 is disposed in a position on the upstream side of the transparent belt 52 in the rotation direction (on the other side in the apparatus width direction) so as to be deviated from the top portion TS1 of the lens 54. The portion which is positioned on the upstream side of the transparent belt 52 in the rotation direction than the portion of the transparent belt 52 facing the top portion TS1 of the lens 54 refers to a portion having a 90°-phase difference from an axial center in a direction opposite to the rotation direction of the transparent belt 52 from the portion of the transparent belt 52 facing the top portion TS1 of the lens 54. In the present exemplary embodiment, the portion having a 90°-phase difference from the axial center in the direction opposite to the rotation direction of the transparent belt 52 is a portion of the transparent belt 52 facing a central portion TS2 of the curved surface 54B of the lens 54.

[Pressure Unit]

As shown in FIG. 2, the pressure unit 40 has a function of forming a nip N by cooperating with the transparent belt 52 coming in contact with the outer peripheral surface of the transparent belt 52 on a side opposite to the curved surface 54B of the lens 54 with the transparent belt 52 interposed therebetween. The pressure unit 40 has a function of pressurizing the toner image G on the medium P transported to the nip N by cooperating with the transparent belt 52.

The pressure unit 40 includes a cylindrical member 42, the cap (not shown), and the gear (not shown). The cylindrical member 42 is disposed in the apparatus depth direction. The cap (not shown) is fitted to the end of the cylindrical member 42 on the front side in the apparatus depth direction, and the gear (not shown) is fitted to the end thereof on the back side in the apparatus depth direction. The gear (not shown) rotates around the axis (its own axis) by the driving source (not shown), and thus, the cylindrical member 42 rotates around the axis (in the direction of the arrow R2 in the drawing).

The cylindrical member 42 may be deformed, and forms the nip N that nips the transparent belt 52 coming in contact with a portion opposite to the curved surface 54B of the lens 54 with the transparent belt 52 interposed therebetween. The nip N is formed so as to have the portion of the outer peripheral surface of the transparent belt 52 facing the central portion TS2 of the curved surface 54B. Thus, the light LB applied by the light source 66 is concentrated on the portion of the cylindrical member 42 that pressurizes the medium P.

[Supplement]

In the above-mentioned description, the configuration of the fixing device 20 has been described for the respective components of the fixing device 20. Here, a relationship between the components of the fixing device 20 will be further described.

<Supplement 1>

As stated above, the top portion TS1 of the curved surface 54A of the lens 54 is closest to the inner peripheral surface of the transparent belt 52. From a different perspective, gaps are formed between the inner peripheral surface of the transparent belt 52 and the portions of the curved surface 54A other than the top portion TS1. Here, as shown in FIG. 2, the gap on the upstream side of the transparent belt 52 in the rotation direction with respect to the portion of the transparent belt 52 facing the top portion TS1 is referred to as a gap GA1, and the gap on the downstream side of the transparent belt 52 in the rotation direction with respect to the portion of the transparent belt facing the top portion is referred to as a gap GA2.

<Supplement 2>

As described above, the silicone oil O impregnated in the supply unit 58 is supplied to the entire inner peripheral surface of the transparent belt 52 by the rotation of the transparent belt 52 around the axis. Thus, the transparent belt 52 rotates around the axis while the silicone oil O adheres to the inner peripheral surface thereof.

<Supplement 3>

Since the fixing device 20 has the same features as Supplement 1 and Supplement 2 described above, the fixing device 20 performs the fixing operation while the silicone oil O stays in the gap GA1. The light LB which is output from the light source 66 and is transmitted through the transparent belt 52 is transmitted through the silicone oil O staying in the gap GA1, is incident on the curved surface 54A of the lens 54, and is concentrated on the curved surface 54B.

The configuration of the fixing device 20 and the configuration of the image forming apparatus 10 according to the present exemplary embodiment have been described.

[Operation of Image Forming Apparatus]

Next, the operation of the image forming apparatus 10 according to the present exemplary embodiment will be described with reference to the drawings.

When receiving an image forming instruction, the control unit 16 operates the transport unit 12, the toner image forming unit 14 and the fixing device 20. In this case, in the toner image forming unit 14, the toner image G is formed on the medium P transported by the transport unit 12 by performing the processes such as charging, exposing, developing and transferring. The medium P on which the toner image G has been formed is transported toward the fixing device 20 by the transport unit 12. The medium P on which the toner image G has been formed passes through the nip N formed with the transparent belt 52 and the cylindrical member 42 of the fixing device 20. In this case, the toner image G on the medium P is pressurized by the cylindrical member 42. As stated above, since the light LB output from the light source 66 is concentrated on the portion of the medium P pressurized by the cylindrical member 42, the toner image G on the medium P is heated by the light LB concentrated on the curved surface 54B of the lens 54 for a partial period of a period during which the toner image passes through the nip N. Thus, the toner image G on the medium P passed through the nip N is fixed on the medium P. The medium P on which the toner image G has been fixed is discharged to the outside of the image forming apparatus 10, and the operation of the image forming apparatus 10 is ended.

The operation of the image forming apparatus 10 has been described.

[Effect]

Next, the effects of the present exemplary embodiment will be described with reference to the drawings. Here, the effects of the present exemplary embodiment will be described by comparing the present exemplary embodiment with a comparative example to be described below. In the comparative example, it will be described that when the same components as those in the image forming apparatus 10 according to the present exemplary embodiment are used, the reference numerals of the components are used.

Figure 4:
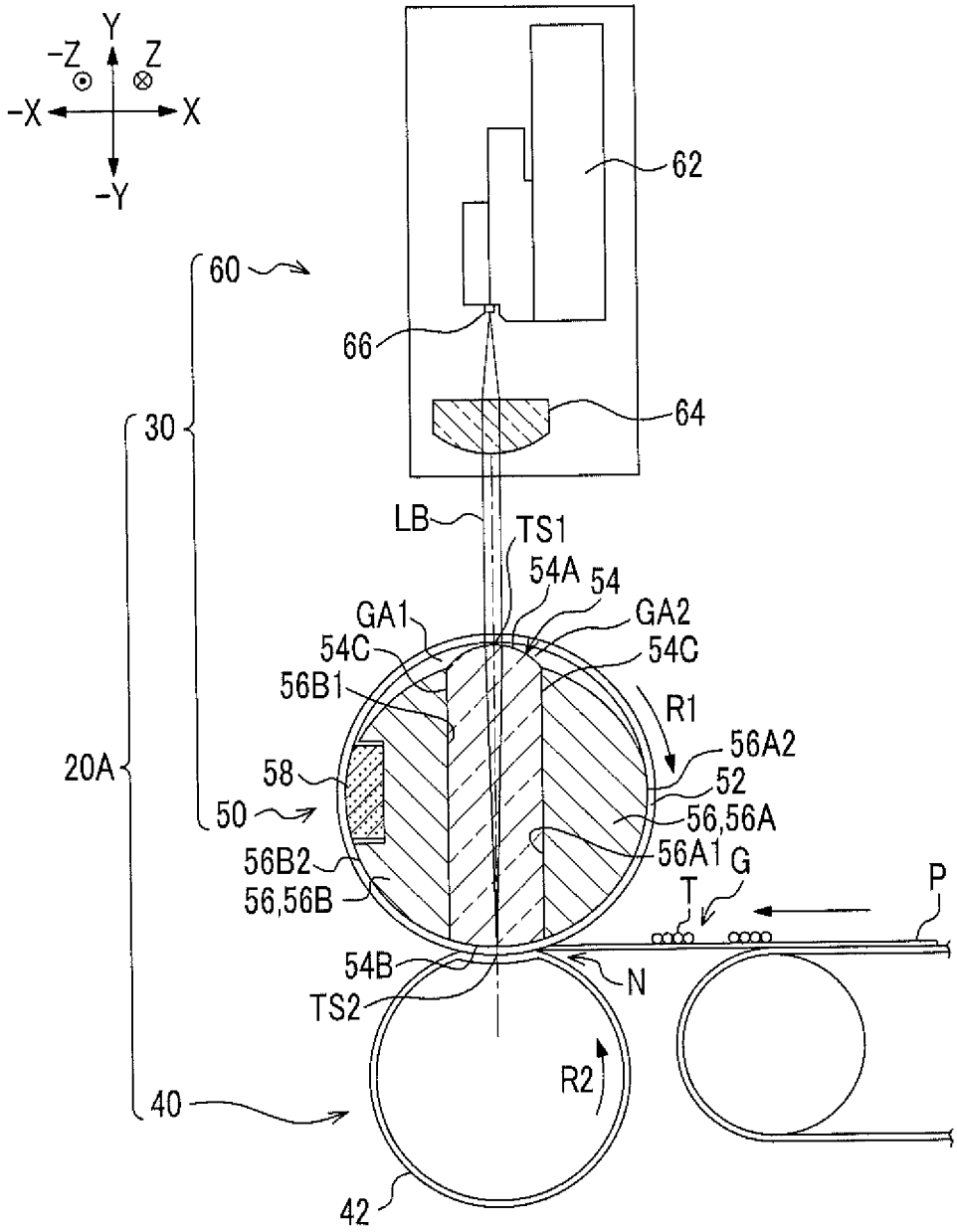
FIG. 4 is a schematic diagram (front view) showing a fixing device according to a comparative example.

As shown in FIG. 4, a fixing device 20A according to the comparative example is different from the fixing device 20 according to the present exemplary embodiment in that the light irradiation unit 60 is differently disposed. Specifically, the light source 66 of the fixing device 20A is disposed such that an optical axis of the light LB is overlapped with the top portion TS1 of the lens 54 when viewed in the apparatus depth direction. Except for the difference, the fixing device 20A has the same configuration as that of the fixing device 20 according to the present exemplary embodiment. Except for the fact that the fixing device 20A is provided, an image forming apparatus 10A according to the comparative example has the same configuration as that of the image forming apparatus 10 according to the present exemplary embodiment.

As mentioned above, the portion on the inner peripheral surface of the transparent belt 52 facing the top portion TS1 of the lens 54 is closest to the top portion TS1 of the curved surface 54A of the lens 54. The gap GA1 is formed on the upstream side of the transparent belt 52 in the rotation direction with respect to the portion of the transparent belt 52 facing the top portion TS1. Thus, in the fixing device 20A, the silicone oil O stays in the gap GA1 along with the rotation of the transparent belt 52. The silicone oil O staying in the gap GA1 reaches up to a region near the top portion TS1 along with the rotation of the transparent belt 52, but does not move beyond the top portion TS1 due to adhering force of the silicone oil O to the transparent belt 52 and because there is a short separation distance between the top portion TS1 and the transparent belt 52. Thus, as shown in FIG. 5, the silicone oil O does not uniformly adhere to the top portion TS1 of the lens 54 in some cases.

As mentioned above, in the fixing device 20, the silicone oil O adheres to the inner peripheral surface of the transparent belt 52. The silicone oil O adhering to the inner peripheral surface of the transparent belt 52 reaches up to the region near the top portion TS1 of the lens 54 along with the rotation of the transparent belt 52, but receives a downward force due to the weight of the silicone oil. Thus, as shown in FIG. 5, the silicone oil O does not uniformly adhere to the top portion TS1 of the lens 54 in some cases.

Figure 5:
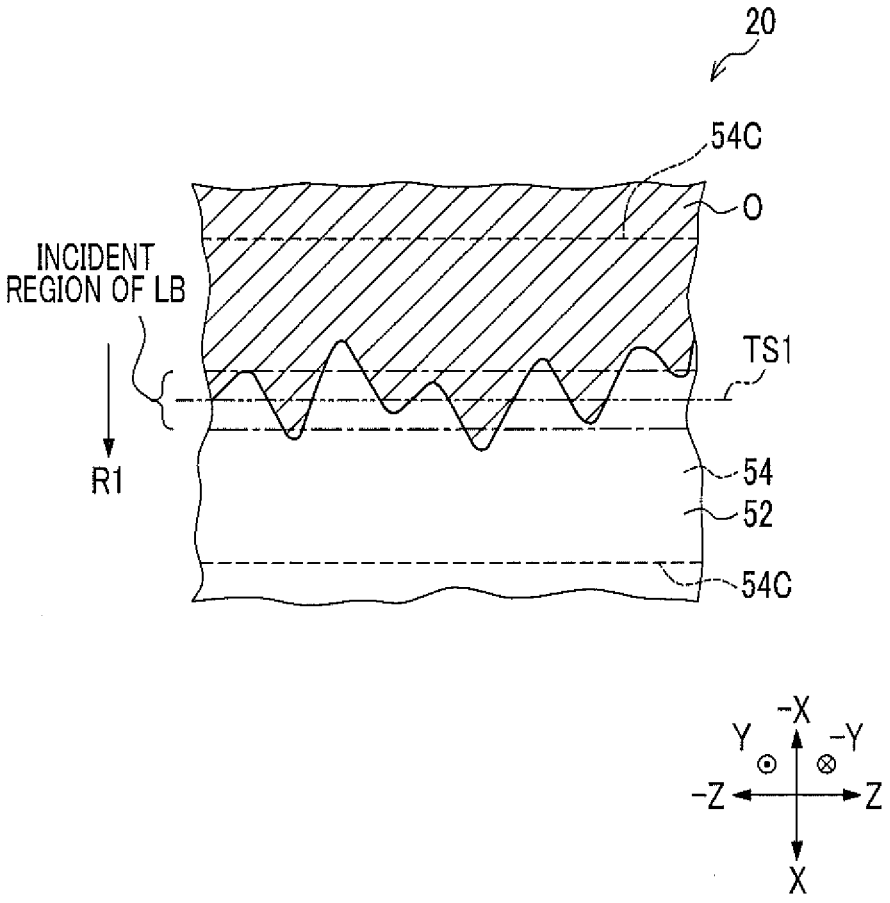
FIG. 5 is a perspective view of a belt of the fixing device of the comparative example when viewed from the top, and is also a schematic diagram showing a portion of the belt on which light is incident.

In the fixing device 20A, as shown in FIG. 5, the light LB output from the light source 66 is incident while the optical axis is overlapped with the top portion TS1 of the lens 54. Thus, the light LB which is transmitted through the transparent belt 52 and then is incident on the curved surface 54A through the silicone oil O and the light LB which is incident on the curved surface 54A through an air space without passing through the silicone oil O may be mixed and concentrated on the entire irradiation width of the curved surface 54B of the lens 54 with the light LB. For this reason, in the fixing device 20A, a concentrating failure of the light LB concentrated on the entire irradiation width of the curved surface 54B with the light LB may occur due to a difference in absorptance of the light LB between the silicone oil O and the air space.

Figure 6:
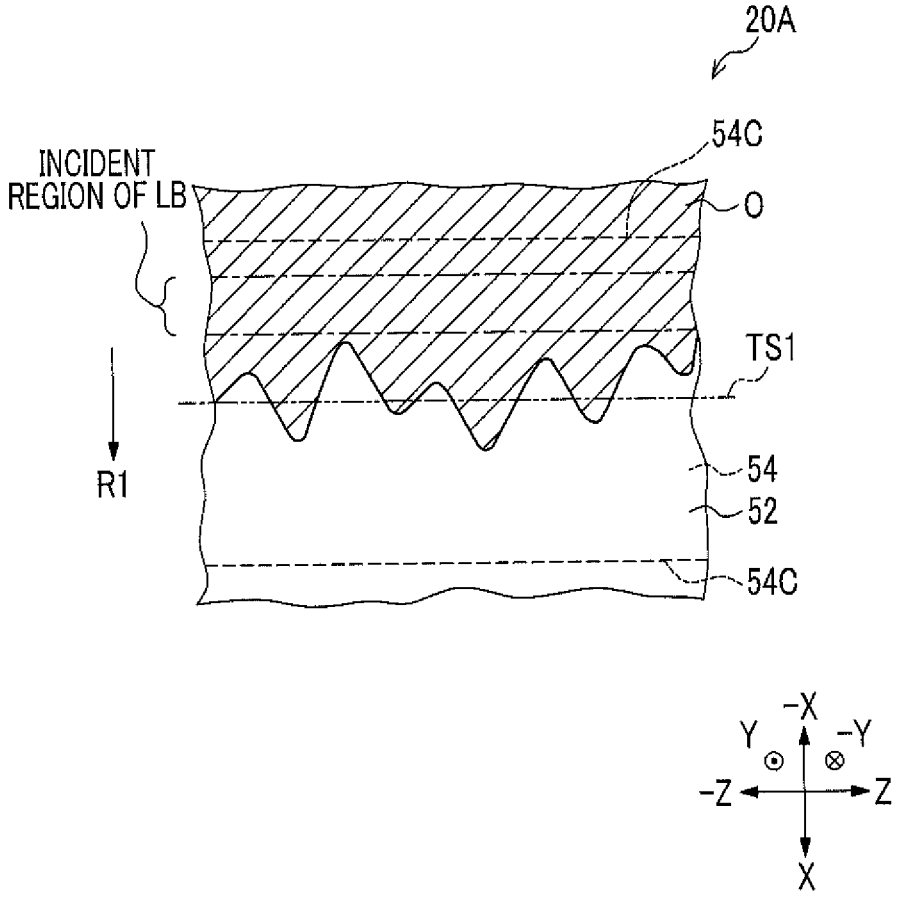
FIG. 6 is a perspective view of the belt of the fixing device according to the first exemplary embodiment when viewed from the top, and is also a schematic diagram showing a portion of the belt on which light is incident.

By contrast, in the fixing device 20 according to the present exemplary embodiment, the light source 66 allows the light LB to be incident on the portion on the upstream side of the transparent belt 52 in the rotation direction from the portion of the outer peripheral surface of the transparent belt 52 facing the top portion TS1 of the lens 54. Thus, as shown in FIG. 6, the light LB which is output from the light source 66 and is incident on the transparent belt 52 is transmitted through the transparent belt 52, is transmitted through the silicone oil O staying in the gap GA1, and is incident on the curved surface 54A of the lens 54 on the entire irradiation width with the light LB. As a result, in the fixing device according to the present exemplary embodiment, the concentrating failure of the light LB concentrated on the entire irradiation width of the curved surface 54B with the light LB due to a difference in absorptance of the light LB between the silicone oil O and the air space may not occur.

Therefore, according to the fixing device 20 according to the present exemplary embodiment, it is possible to suppress the light concentrating failure as compared to the fixing device 20A of the comparative example. Thus, according to the image forming apparatus 10 according to the present exemplary embodiment, it is possible to suppress an image forming failure caused by the fixing failure as compared to the image forming apparatus 10A of the comparative example.

In the fixing device 20 according to the present exemplary embodiment, even when the top portion TS1 of the lens 54 comes in contact with the inner peripheral surface of the transparent belt 52, it is possible to suppress the light concentrating failure as compared to the fixing device 20A of the comparative example.

Second Exemplary Embodiment

Next, a fixing device 20B according to a second exemplary embodiment will be described with reference to FIG. 7. In the present exemplary embodiment, it will be described that when the same components as those in the image forming apparatus 10 according to the first exemplary embodiment are used, the reference numerals of the components are used.

[Configuration]

Figure 7:
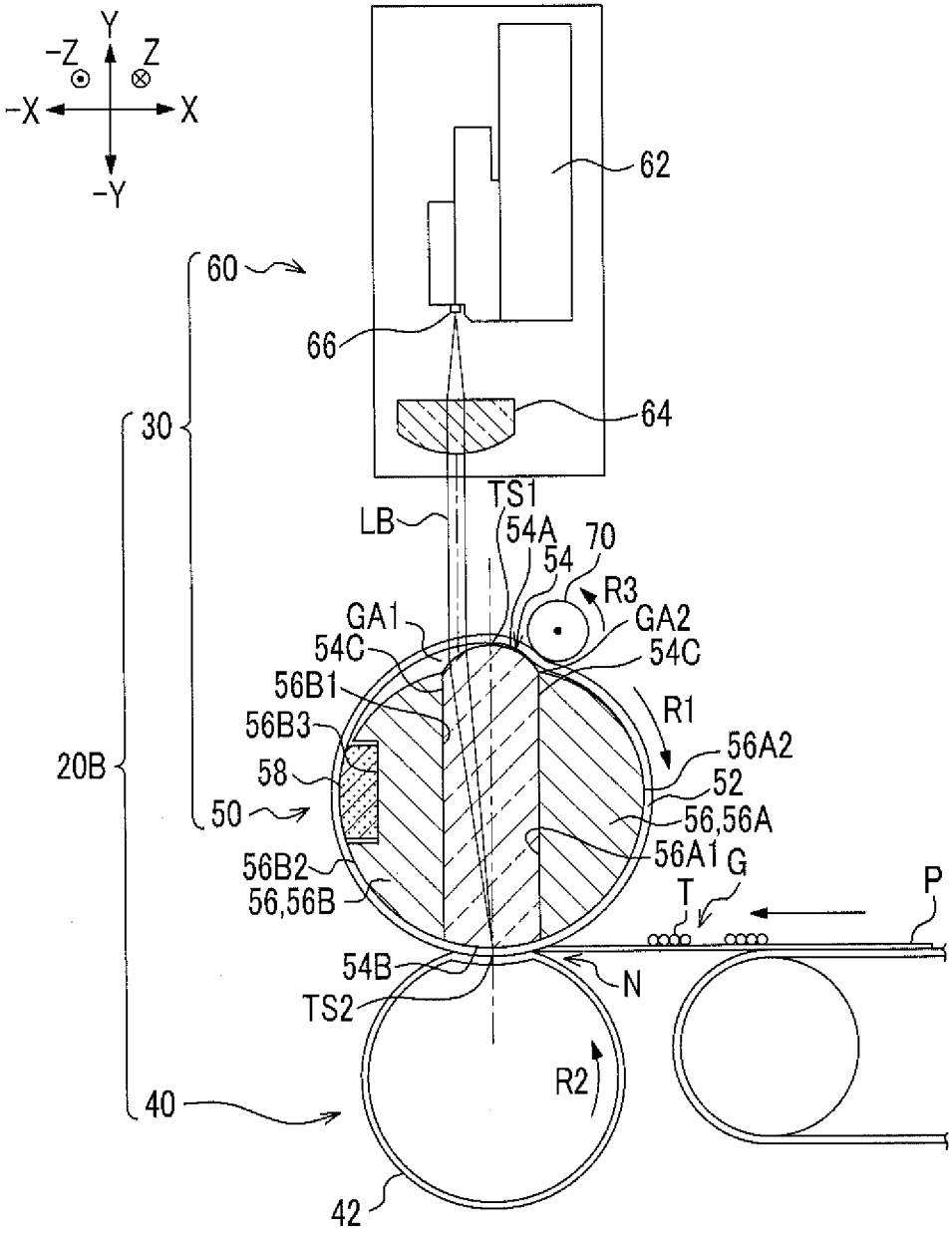
FIG. 7 is a schematic diagram (front view) showing a fixing device constituting an image forming apparatus according to a second exemplary embodiment.

As shown in FIG. 7, the fixing device 20B according to the present exemplary embodiment includes a pushing member 70 that pushes the inner peripheral surface of the transparent belt 52 toward the portion of the curved surface 54A of the lens 54 on the downstream side of the transparent belt 52 from the top portion TS1 in the rotation direction by pressing against the outer peripheral surface of the transparent belt 52. Except for the above-described difference, the fixing device 20B has the same configuration as that of the fixing device 20 according to the first exemplary embodiment. Except for the fact that the fixing device 20B is provided, an image forming apparatus 10B according to the present exemplary embodiment has the same configuration as that of the image forming apparatus 10 according to the first exemplary embodiment.

The pushing member 70 is a long roll that may rotate around an axis. The pushing member 70 is disposed with the axial direction thereof parallel to the apparatus depth direction. The transparent belt 52 rotates, and thus, the pushing member 70 rotates in the direction represented by an arrow R3 along with the rotation of the transparent belt 52. The pushing member 70 pushes the inner peripheral surface of the transparent belt 52 toward the portion of the curved surface 54A of the lens 54 on the downstream side of the transparent belt 52 from the top portion TS1 in the rotation direction, and thus, the gap GA2 is formed so as to have a smaller size than that in the fixing device 20 according to the first exemplary embodiment.

[Effect]

Figure 8:
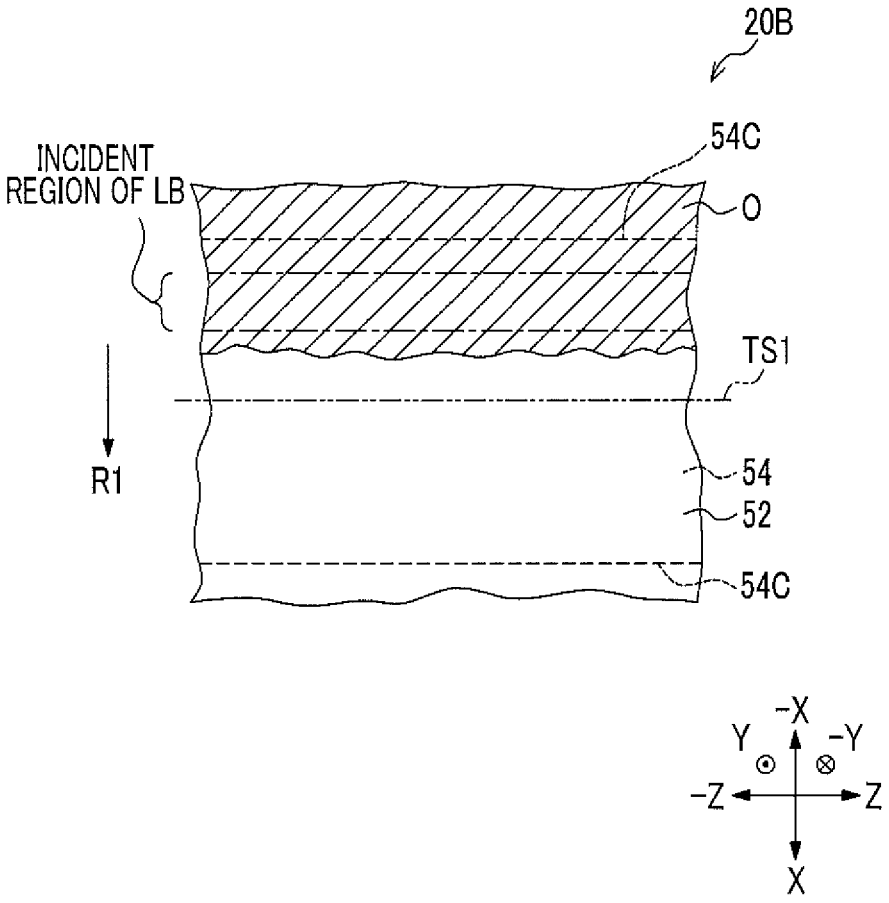
FIG. 8 is a perspective view of a belt of the fixing device according to the second exemplary embodiment when viewed from the top, and is also a schematic diagram showing a portion of the belt on which light is incident.

As stated above, in the fixing device 20B according to the present exemplary embodiment, the pushing member 70 pushes the transparent belt 52 toward the portion of the curved surface 54A of the lens 54 on the downstream side of the transparent belt 52 from the top portion TS1 in the rotation direction. Thus, in the fixing device 20B, as compared to the fixing device 20 according to the first exemplary embodiment, the portion of the rotating transparent belt 52 which faces the curved surface 54A is difficult to be deviated. As a result, as shown in FIG. 8, in the fixing device 20B, the end on the downstream side of the transparent belt 52 in the rotation direction in the silicone oil O staying in the gap GA1 is easily set in the width direction of the transparent belt 52 as compared to the fixing device 20 according to the first exemplary embodiment.

Thus, according to the fixing device 20B according to the present exemplary embodiment, it is possible to suppress the light concentrating failure as compared to the fixing device 20 according to the first exemplary embodiment. Therefore, according to the image forming apparatus 10B according to the present exemplary embodiment, it is possible to suppress the fixing failure caused by the light concentrating failure as compared to the image forming apparatus 10 according to the first exemplary embodiment. Other effects according to the present exemplary embodiment are the same as those in the first exemplary embodiment.

Third Exemplary Embodiment

Next, a fixing device 20C according to the third exemplary embodiment will be described with reference to FIG. 9. In the present exemplary embodiment, it will be described that when the same components as those in the image forming apparatus 10 according to the first exemplary embodiment are used, the reference numerals of the components are used.

[Configuration]

Figure 9:
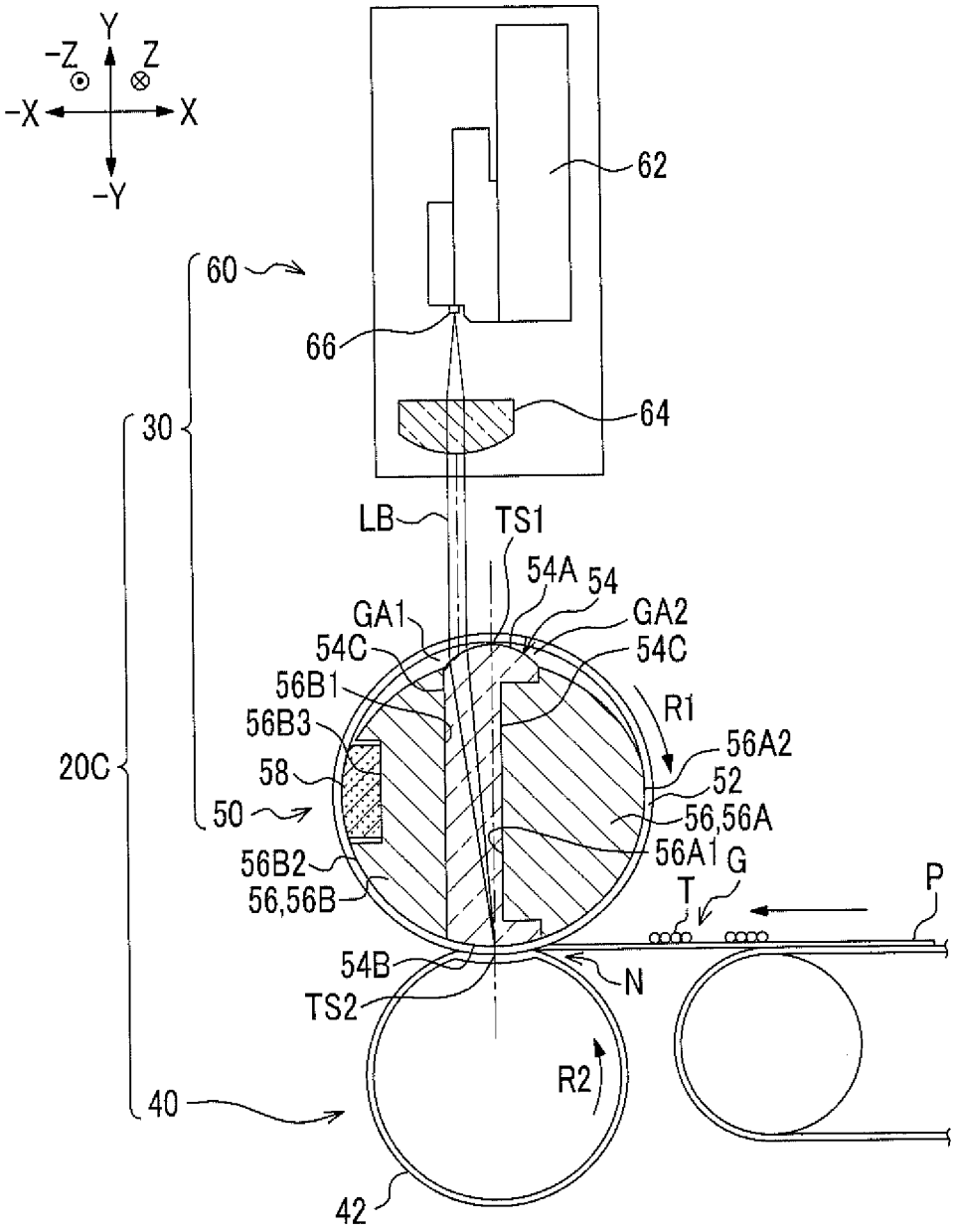
FIG. 9 is a schematic diagram (front view) showing a fixing device constituting an image forming apparatus according to a third exemplary embodiment.

As shown in FIG. 9, in the lens 54 constituting the fixing device 20C according to the present exemplary embodiment, when viewed in the apparatus depth direction, the planar surface 54C of the lens 54 on the downstream side of the transparent belt 52 from the top portion TS1 in the rotation direction is recessed (a recess is formed). A protrusion 56A1 fitted into the recess of the lens 54 is formed in a portion of the first guide section 56A constituting the fixing device 20C according to the present exemplary embodiment, which is close to the lens 54. As shown in FIG. 9, when viewed in the apparatus depth direction, a portion surrounded by the recess of the lens 54 and the optical path of the light LB in the lens 54 (a path through which the light LB passes) are not overlapped. Except for the aforementioned difference, the fixing device 20C has the same configuration as that of the fixing device 20 according to the first exemplary embodiment. Except for the fact that the fixing device 20C is provided, an image forming apparatus 10C according to the present exemplary embodiment has the same configuration as that of the image forming apparatus 10 according to the first exemplary embodiment.

[Effect]

According to the fixing device 20C according to the present exemplary embodiment, it is possible to reduce the volume of the lens 54 as compared to the fixing device 20 according to the first exemplary embodiment. That is, according to the fixing device 20C according to the present exemplary embodiment, it is possible to reduce the size of the lens 54 as compared to the fixing device 20 according to the first exemplary embodiment. Other effects according to the present exemplary embodiment are the same as those in the first exemplary embodiment.

As described above, although the present invention has been described in detail in conjunction with the specific exemplary embodiments, the present invention is not limited to the aforementioned exemplary embodiments, and other exemplary embodiments are possible within the scope of the technical ideals of the present invention.

For example, in the fixing devices 20 and 20B according to the respective exemplary embodiments, it has been described that the silicone oil O adheres to the inner peripheral surface of the transparent belt 52 by bringing the supply unit 58 in which the silicone oil O is impregnated into contact with the inner peripheral surface of the transparent belt 52. However, if the silicone oil O has adhered to the inner peripheral surface of the transparent belt 52, the supply unit 58 may not be provided to the fixing devices 20 or 20B.

In the fixing devices 20 and 20B according to the respective exemplary embodiments, it has been described that the silicone oil O is used as an example of the lubricating liquid. However, as long as the liquid may reduce friction due to the sliding of the transparent belt 52 on the lens 54 and the guide unit 56 arranged inside the transparent belt 52 and transmit the light LB, the lubricating liquid used in the fixing devices 20 and 20B according to the present exemplary embodiment may not be the silicone oil O. For example, paraffin oil may be used.

In the fixing devices 20 and 20B according to the respective exemplary embodiments, it has been described that the cylindrical member 42 constituting the pressure unit 40 rotates around the axis by the driving source. However, any member may be used as long as the cylindrical member 42 may rotate around the axis by forming the nip N in cooperation with the transparent belt 52 during the fixing operation. For example, the cylindrical member 42 may rotate along with the rotation of the transparent belt 52.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an endless belt that rotates around an axis, transmits light, and has an inner peripheral surface to which a lubricating liquid adheres;

a lens that has a curved surface having a top portion closest to the inner peripheral surface at one end when viewed in the axial direction, and concentrates light incident on the curved surface on a developer image on a medium that comes in contact with an outer peripheral surface of the belt that comes in contact with the other end; and a light source that allows the light to be concentrated on the developer image to be incident on a portion on an upstream side of the belt of an outer peripheral surface of a portion of the belt facing the top portion in the rotation direction.

2. The fixing device according to claim 1, wherein the top portion comes in contact with the inner peripheral surface.

3. The fixing device according to claim 1, further comprising:

a pushing member that pushes the inner peripheral surface toward a portion of the curved surface on a downstream side of the top portion in the rotation direction by pressing against the outer peripheral surface.

4. The fixing device according to claim 2, further comprising:

a pushing member that pushes the inner peripheral surface toward a portion of the curved surface on a downstream side of the top portion in the rotation direction by pressing against the outer peripheral surface.

5. The fixing device according to claim 1, wherein a side surface of the lens on a downstream side of the belt of the top portion in the rotation direction when viewed in an apparatus depth direction is recessed.

6. The fixing device according to claim 2, wherein a side surface of the lens on a downstream side of the belt of the top portion in the rotation direction when viewed in an apparatus depth direction is recessed.

7. The fixing device according to claim 3, wherein a side surface of the lens on a downstream side of the belt of the top portion in the rotation direction when viewed in an apparatus depth direction is recessed.

8. The fixing device according to claim 4, wherein a side surface of the lens on a downstream side of the belt of the top portion in the rotation direction when viewed in an apparatus depth direction is recessed.

9. An image forming apparatus comprising:

a forming unit that forms a developer image on the medium; and the fixing device according to claim 1 that fixes the developer image on the medium.

10. An image forming apparatus comprising:

a forming unit that forms a developer image on the medium; and the fixing device according to claim 2 that fixes the developer image on the medium.

* * * * *